US005780823A

United States Patent [19]

Uehashi

[11] Patent Number: 5,780,823

[45] Date of Patent: Jul. 14, 1998

[54] COOKING METHOD USING A MICROWAVE OVEN

[75] Inventor: Hiroyuki Uehashi, Koka-gun, Japan

[73] Assignee: Sanyo Electric Co., Ltd., Osaka, Japan

[21] Appl. No.: 804,539

[22] Filed: Feb. 24, 1997

[30] Foreign Application Priority Data

Feb. 29, 1996 [JP] Japan ..... 8-071506

[51] Int. Cl.[6] ..... H05B 6/68

[52] U.S. Cl. ..... 219/710; 219/711; 219/734; 219/719; 99/325

[58] Field of Search ..... 219/710, 711, 219/705, 734, 719; 99/325; 426/243

[56] References Cited

U.S. PATENT DOCUMENTS

| | | | |
|---|---|---|---|
| 4,281,022 | 7/1981 | Buck . | |
| 4,401,884 | 8/1983 | Kusunoki et al. . | |
| 4,831,227 | 5/1989 | Eke | 219/710 |
| 4,894,502 | 1/1990 | Oh | 219/710 |
| 5,422,465 | 6/1995 | Kim et al. | 219/710 |
| 5,530,229 | 6/1996 | Gong et al. . | |

FOREIGN PATENT DOCUMENTS

| | | | |
|---|---|---|---|
| 0-587-323-A1 | 3/1994 | European Pat. Off. . | |
| 2-46101 | 7/1984 | Japan . | |
| 64-5435 | 10/1984 | Japan . | |
| 63-201429 | 8/1988 | Japan | 219/711 |
| 63-207921 | 8/1988 | Japan | 219/711 |
| 4-90420 | 3/1992 | Japan . | |
| 2-206-425 | 1/1989 | United Kingdom . | |

*Primary Examiner*—Philip H. Leung
*Attorney, Agent, or Firm*—Oliff & Berridge

[57] ABSTRACT

Since, food sealed tightly in a packaged does not permit steam to be released from the food during heating, conventional microwave ovens using a hygrometer cannot identify the type of food, and an automatic heating is therefore impossible. A microwave oven of the present invention includes: a temperature detector for detecting the temperature at the top of the lid of the package of a packaged food; a first calculating unit for calculating a first parameter representing a degree of rise in the detected temperature during a period of time since the heating is started until a predetermined change in the detected temperature is attained; a second calculating unit for calculating a second parameter representing a degree of rise in the temperature after the predetermined change in the temperature is attained. A controller judges the amount of food in the packaged food based on the first parameter, and judges the packing state of the packaged food based on the second parameter. Based on the judgements, or according to the parameters, the controller selects an appropriate heating mode for the packaged food out of a plurality of heating modes varying in the maximum heating time and in the maximum temperature. The heating unit (magnetron) is controlled by the controller according to the heating mode selected.

14 Claims, 3 Drawing Sheets

| MODE | | t0 [sec] | α [°C] | 1ST STAGE | | | 2ND STAGE | | 3RD STAGE | |
|---|---|---|---|---|---|---|---|---|---|---|
| | | | | RISE [°C] | Tmax [°C] | tmax [min] | tmax [min] | Tmax [°C] | tmax | Tmax [°C] |
| A | 1 | t0<18 | α<6 | 18 | 50 | 1 | 1 | 60 | 0.7×t | 65 |
| | 2 | | 6≦α<13 | | | | 0.75 | 60 | 0.7×t | 60 |
| | 3 | | α≧13 | | | | 0.5 | 60 | 0.7×t | 60 |
| B | 1 | 18≦t0<26 | α<8 | 18 | 50 | 1 | 1 | 55 | 0.7×t | 60 |
| | 2 | | 8≦α<13 | | | | 0.75 | 60 | 0.7×t | 65 |
| | 3 | | α≧13 | | | | 0.5 | 60 | 0.7×t | 80 |
| C | 1 | t0≧26 | α<10 | 18 | 50 | 1 | 1 | 50 | 0.7×t | 52 |
| | 2 | | 10≦α<15 | | | | 0.75 | 50 | 0.7×t | 60 |
| | 3 | | α≧15 | | | | 0.5 | 50 | 0.7×t | 70 |

COOKING METHOD USING A MICROWAVE OVEN

The present invention relates to a microwave oven, particularly to a heat control system of the microwave oven suitable for heating a packaged food seated up with a lid or by a plastic wrap.

BACKGROUND OF THE INVENTION

Some conventional microwave ovens are known that can automatically detect the type of food put in the oven and determine an appropriate heating time. One of these such microwave ovens is disclosed in the Japanese Examined Patent Publication No. H2-46101 (which corresponds to the Japanese Unexamined Patent Publication No. S59-120949). The microwave oven includes a humidity sensor, or hygrosensor, disposed in the heating chamber. The hygrosensor measures the absolute humidity in the heating chamber due to the steam released from the food heated. Based on the change in the humidity per unit time, the type of the food is identified, and the amount of input heat and the heating time are determined according to the type identified.

In convenience stores or food shops, food is often sold packaged in a tray with a lid or in a tray covered by a plastic wrap made of vinylidene chloride or the like. The tray and the lid are sometimes tightly sealed and the plastic wrap sometimes wraps the whole package hermetically.

When a packaged food is heated, steam is given off from the food. If, however, the package is tightly sealed, the steam does not leak out but is kept inside the package. In such case, in the above described conventional microwave oven, the type of food is wrongly identified, and the amount of input heat and the heating time thus determined are inappropriate for the food. This tends to lead to an overheating wherein the packaged food is heated for a considerably long time. If the package is made of plastic or the like, it may be deformed by heat and the steam leaks out of the package and the wrapping, which may be detected by the hygrosensor too late.

The Japanese Examined Patent Publication No. S64-5435 (which corresponds to Japanese Unexamined Patent Publication No. S59-175588) discloses another microwave oven constituted so that the temperature at the surface of the food is detected by an infrared sensor. The size of the food is identified based on the rising rate of the temperature detected during the heating process, and an appropriate heating time is determined according to the size identified. When, however, a packaged food with a transparent lid is heated, the temperature detected by the infrared sensor mainly reflects the temperature at the surface of the lid or the plastic wrap, not the temperature at the surface of the food, because the infrared detection can hardly pass through the lid. Further, the manner in which the temperature rises depends not only on the type or size of the food in the package, but considerably on whether the food is in contact with the lid. Thus, in the conventional microwave oven, the size of the food is sometimes wrongly identified and the food is heated inappropriately in the case of packaged foods.

The Japanese Unexamined Patent Publication No. H4-90420 discloses a microwave oven particularly suitable for cooking rice. The microwave oven includes a thermosensor for measuring the temperature at the lid of the package containing rice and water, and a hygrosensor for measuring the absolute humidity due to the steam released from the food, both being disposed in the heating chamber. In an initial phase of the heating, the type of the lid is identified based on a change in the temperature in a predetermined period of time. Then the amount of rice is detected based on a change in the temperature per unit time and on a time required for the absolute humidity to rise by a predetermined amount.

The above microwave oven, however, can be applicable only to a particular sort of cooking, i.e. rice cooking, and cannot be suitably applied to heating foods of various package sizes and various food types. Further, the microwave oven is not suitable for heating a sealed packaged food because, as described above, the humidity detection is meaningless in such a case.

DISCLOSURE OF THE INVENTION

The present invention is accomplished in view of the above described problems, and an object of the present invention is to provide a microwave oven that can preferably heat and cook a sealed packaged food. A microwave oven according to the present invention includes:

a) heating means for heating by microwave an object contained in a container with a lid;

b) temperature detecting means for detecting the temperature at the top of the lid of the container;

c) first calculating means for calculating a first parameter representing a degree of rise in the temperature during a predetermined period of time in an initial phase of a heating of the object;

d) second calculating means for calculating a second parameter representing a degree of rise in the temperature after the predetermined period of time; and e) control means for controlling the heating means based on the first and second parameters.

The lid cited above includes a plastic wrap that wraps the container containing the object.

In heating an object in a container, or, more specifically, a packaged food, how long it takes for the temperature at the lid to rise by a predetermined amount depends on the amount of food contained therein. After the temperature rises by the predetermined amount, however, the change in the temperature per unit time depends on the type of the food and on the size of the space between the food and the lid. The reason is explained as follows. When the food is heated, hot steam or gas is released from the food, which fills the space between the food and the lid, so that the temperature of the lid rises due to the heat conducted from the steam or gas to the lid. The heat capacity of the lid made of vinyl chloride or the like is normally smaller than that of the food. Therefore, if the space between the food and the lid is large, the temperature at the lid is largely influenced by the hot steam or gas, resulting in a larger change in the temperature per unit time. If, on the other hand, the food is in contact with the lid, the temperature of the lid is almost equal to that of the food, resulting in a smaller change in the temperature per unit time.

In the microwave oven according the present invention, the first calculating unit calculates the first parameter representing the degree of rise in the temperature in an initial phase of the heating, and the second calculating unit calculates the second parameter representing the degree of rise in the temperature in a phase following to the initial phase. The controller judges the amount of food in the packaged food based on the first parameter, and judges the packing state of the packaged food based on the second parameter, as explained above. Based on the judgements, or according to the parameters, the controller selects an appropriate heating mode for the packaged food out of a plurality of heating modes varying in the maximum heating time and in the maximum temperature. The heating unit (e.g. a magnetron) is controlled by the controller according to the heating mode selected.

In the microwave oven according to the present invention, the first calculating unit may calculate the first parameter representing the degree of rise in the temperature during a period of time since the heating of the object is started until a predetermined change in the temperature detected by the temperature detecting unit is attained. The first calculating unit may otherwise calculate the first parameter representing the degree of rise in the temperature during a period of time since the heating of the object is started until a predetermined value of the temperature detected by the temperature detecting unit is attained.

In the microwave oven according to the present invention, the first and/or second calculating unit may be constituted so that the time required for the temperature to change by a predetermined amount is utilized as the parameter representing the degree of rise in the temperature. The first and/or second calculating unit may be otherwise constituted so that the change in the temperature per unit time is utilized as the parameter representing the degree of rise in the temperature.

For example, the microwave oven according to the present invention may be constituted so that the first calculating unit calculates the time required for the temperature to change by the predetermined amount since the start of heating, whereafter the second calculating unit calculates the change in the temperature per unit time, and the controller controls the heating unit according to the above time required and the above change in the temperature per unit time.

In addition, in the case where the first calculating unit utilizes the time required for the temperature to change by the predetermined amount since the start of heating as the parameter representing the degree of rise in the temperature in the initial phase of heating, it is necessary to measure the above time while the amount of the steam or gas released from the food is small. Accordingly, for example, it is preferable that the above predetermined amount is set at about 15–20 [°C.].

By the microwave oven according to the present invention, various packaged foods can be cooked properly by the heating mode automatically selected according to the type, amount and packing state of the food packaged in the container. Therefore, the user need not judge the type or amount of food and it is no longer necessary to set the heating temperature, heating time, etc. by himself or by herself, but the packaged food can be heated safely without resulting in excessive heating or insufficient heating.

BRIEF DESCRIPTION OF THE DRAWINGS

Preferred embodiment of the present invention will be described in the following part of the specification referring to the attached drawings wherein.

DESCRIPTION OF THE PREFERRED EMBODIMENT

Figure 1:
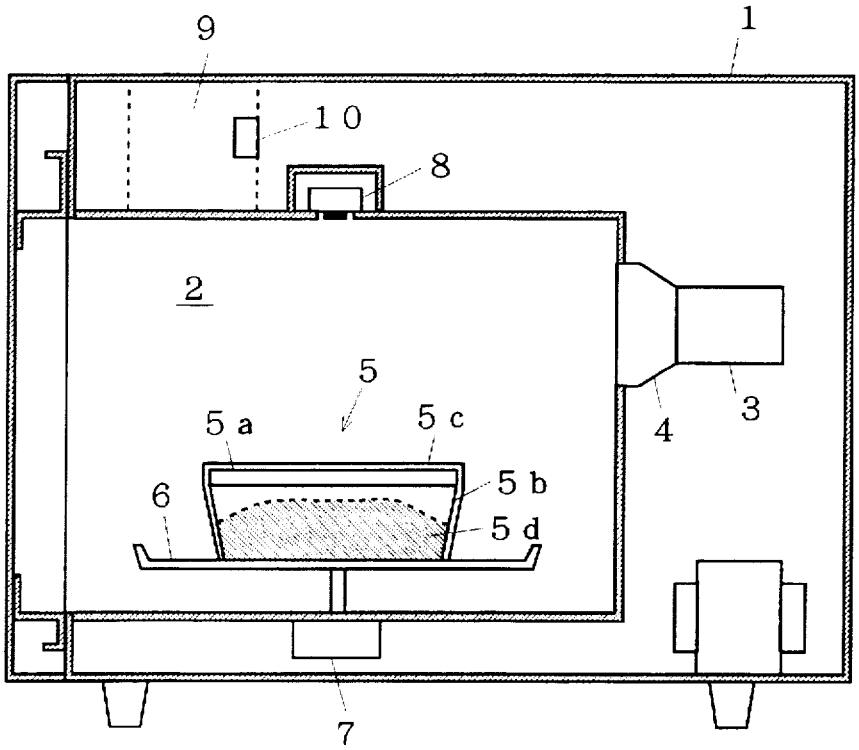
FIG. 1 is a vertical cross-sectional view of the microwave oven in the embodiment of the present invention.

FIG. 1 is a vertical cross-sectional view of a microwave oven embodying the present invention. In a casing 1 of the microwave oven, a heating chamber 2 is disposed, and a magnetron 3 for generating microwave is provided at the back of the heating chamber 2 via a waveguide 4. A turntable 6 rotated by a turntable motor 7 is provided at the bottom of the heating chamber 2, and a heating object 5 is placed on the turntable 6. On the top of the heating chamber 2 is disposed an infrared sensor 8, whereby it is able to detect and measure the temperature emitted by infrared signals from the top of the object 5. An exhaust duct 9 is provided at the top of the heating chamber 2 for letting air or steam out of the heating chamber 2, and a hygrosensor 10 is provided in the exhaust duct 9. In this embodiment, the object 5 consists of a food 5*d* packaged in a tray 5*b* with a lid 5*a* and a plastic wrap 5*c* wrapping the tray 5*b* and the lid 5*a*.

Figure 2:
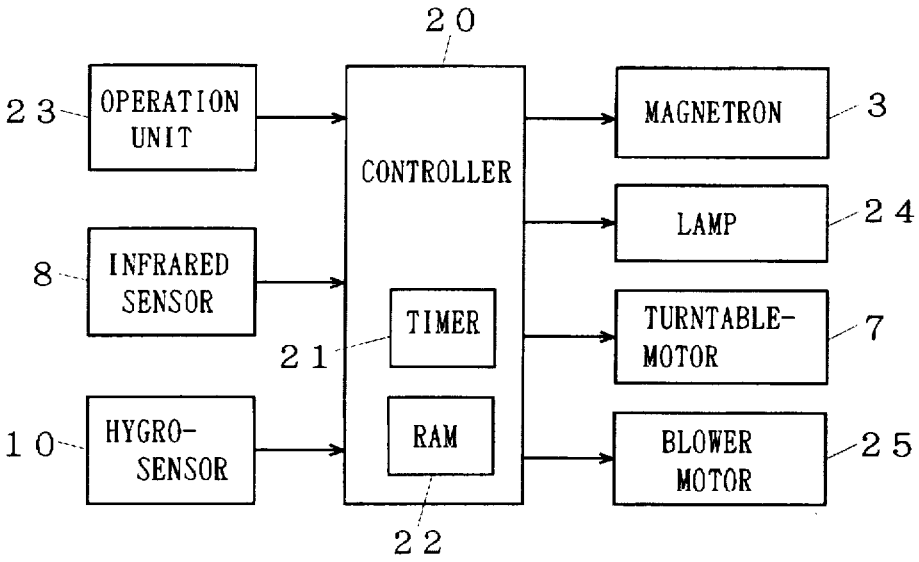
FIG. 2 is a schematic block diagram showing the electrical system of the microwave oven according to the embodiment.

FIG. 2 is a block diagram showing the electrical system of the above microwave oven. A controller 20 is composed of one or plural microcomputers and peripheral elements including a timer 21, random access memory (RAM) 22, etc. An operation unit 23 having a plurality of keys is connected to the controller 20, and signals corresponding to operations on the keys are sent to the controller 20. To the controller 20, a temperature signal and a humidity signal are also sent from the infrared sensor 8 and the hygrosensor 10, respectively. Responsive to the input signals, the controller 20 executes calculations according to control programs stored in a read only memory (ROM) (not shown), and generates various control signals. The control signals include a signal for driving the magnetron 3, a signal for controlling a lamp 24 disposed in the heating chamber 2, a signal for driving the turntable motor 7, and a signal for driving a blower motor 25 for an exhaust fan disposed in the exhaust duct 9 (not shown).

Figure 3:
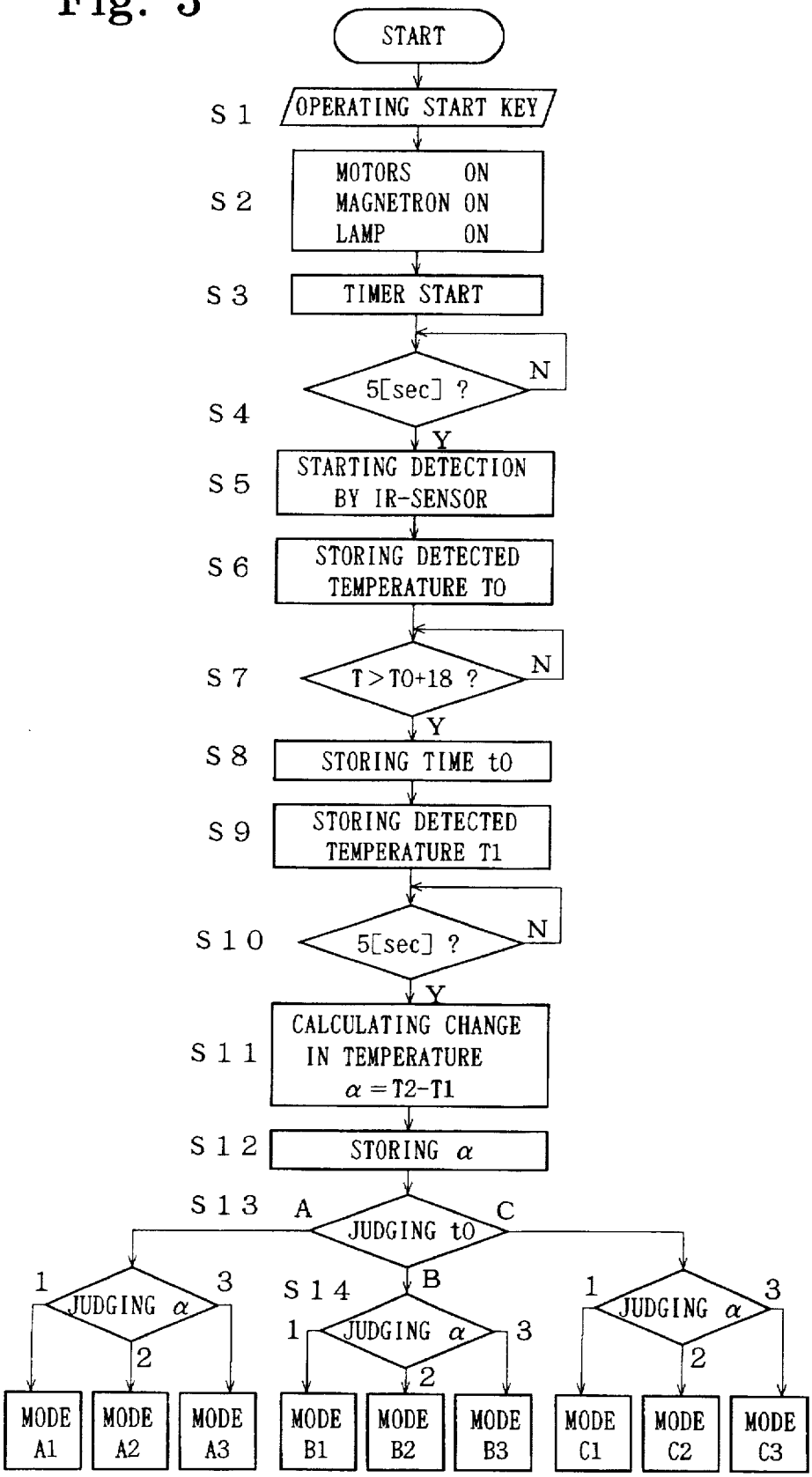
FIG. 3 is a flow chart showing control steps of the heating in the embodiment.

Next, referring to the flow chart in FIG. 3, a heating by the microwave oven constituted as above is described. First a user places a packaged food as the object 5 on the turntable 6, selects an "Automatic Heating for Packaged food" course on the operation unit 23, and pushes a start key (step S1). In response to the key operation, the controller 20 turns on the lamp 24 and sends start signals to the turntable motor 7, the blower motor 25 and the magnetron 3 (step S2), whereby the turntable 6 starts rotating at a low speed and the irradiation of microwave is started. The power of the magnetron 3 is determined by a heating sequence selected as explained later. At the moment the heating is started, the timer 21 in the controller 20 starts counting time (step S3).

Since, generally, it takes a certain short period of time for the infrared sensor 8 to be stabilized after it is energized, the operation is suspended and the temperature signal is disregarded for the first 5 [sec] (step S4). When the timer 21 counts up 5 [sec], the controller 20 starts using the temperature signal from the infrared sensor 8 (step S5). The temperature obtained based on the temperature signal from the infrared sensor 8 is hereinafter referred to as the "detected temperature". In the above process, first the detected temperature obtained just after the process is started is stored in the RAM 22 as T0 (step S6). When the detected temperature attains T0+18 [°C.] (step S7), a time length t0 required for the temperature to rise by 18 [°C.] is calculated by subtracting 5 [sec] (which is the time elapsed in step S4) from the current time counted by the timer 21. The time length t0 calculated here and the current temperature T1 [°C.] (=T0+18 [°C.]) is stored in the RAM 22 (steps S8, S9).

From the time when the detected temperature attains T0+18 [°C.], the operation is again suspended for 5 [sec] (step S10). When the 5 [sec] elapses, the current temperature T2 [°C.] is detected and the temperature change α [°C.] in the 5 [sec] is calculated as α=T2–T1 (step S11), where T1 is restored from the RAM 22. The temperature change α is stored in the RAM 22 (step S12). Based on the time length t0 and the temperature change α, a heating mode is selected from a plurality of the heating modes stored in the ROM beforehand (steps S13, S14).

Figures 4, 5:
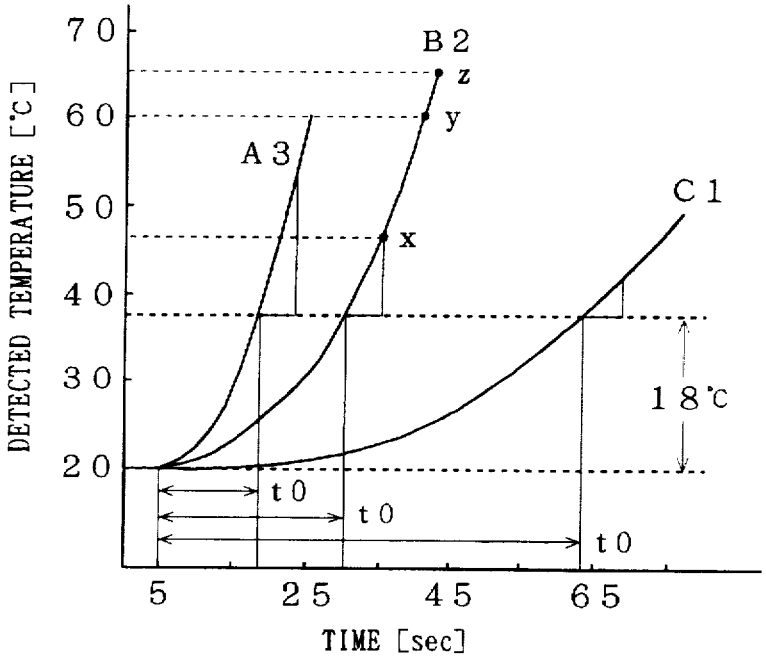
FIG. 4 shows an example of the heating sequence.
FIG. 5 is a graph for explaining that the change in the temperature depends on the food.

FIG. 4 shows an example of a list of heating modes classified by the parameters of the time length t0 and the temperature change α. Each heating mode provides a heating sequence including a first stage, second stage and third stage. In FIG. 4: "t" used in the third stage represents the length of time from the beginning of the first stage to the end of the second stage; "tmax" is the maximum heating time; and "Tmax" is the maximum temperature. When the maximum temperature Tmax is attained, or when the maximum heating time tmax elapses, whichever occurs first, the operation proceeds to the third stage in case of the second stage, or the operation is finished in case of the third stage. The heating sequences are classified into three patterns A, B and C according to the time length t0. Each of the three patterns A, B and C further includes three modes corresponding to the temperature change α. Thus, one of the nine modes of A1–A3, B1–B3 and C1—C3 is selected according to the time t0 and the temperature change α.

The heating sequences as shown in FIG. 4 are normally predetermined through prior experiments in which a variety of packaged foods are actually heated. The heating sequences are stored as a part of the control programs in the ROM provided in the controller 20.

FIG. 5 shows a result of experiments wherein three samples of the packaged foods were heated. In FIG. 5, the abscissa represents the time elapsed since the heating is started, the ordinate represents the detected temperature, and the legends A3, B2 and C1 beside the curves correspond to modes in FIG. 4.

In Japan, various packaged foods are sold in convenience stores, food shops, etc. Some of the examples are as follows. "Souzai" is one of a variety of foods, such as, for example, boiled beans, shredded vegetables, etc., served and taken as side dishes, and is normally packaged in a small package. "Donburi" is an amount of rice with a topping of, for example, boiled meat, tempura, sea food, etc., and is normally packaged in a medium-sized deep bowl-like package. "Bentou" is an assortment of rice and some side dishes packaged together, like a so-called TV dinner, and the package is normally large and flat. The curve A3 in FIG. 5 is the result of heating a souzai package, the curve B2 is the result of heating a donburi package, and the curve C1 is the result of heating a bentou package.

The time length t0 reflects the degree of rise in the detected temperature in the initial phase of heating. Accordingly, it can be said that the shorter the time length t0 is, the more rapidly the detected temperature rises in the initial phase of heating. The rise in the detected temperature in the initial phase of heating greatly depends on the heat capacity of the food 5*d* since the rise in the temperature of the air in the package is mainly caused by the heat conducted from the food 5*d*. That is, when the amount of the food 5*d* is large, the food 5*d* cannot be warmed rapidly, so that the degree of rise in the temperature is small. For example, when a packaged food consists of a small amount of food in a small package, as in the case of souzai described above, the temperature of the food rises so rapidly that the time length t0 is very short. See the curve A3 in FIG. 5.

After the temperature at the surface of the lid 5*a* has risen to some extent, the degree of rise in the detected temperature depends more on the type of the food 5*d* and the size of the space between the food 5*d* and the lid 5*a* rather than on the amount of food 5*d*, as explained before. For example, when a food in a flat package, such as a bentou package as described above, is heated, the temperature at the surface of the lid 5*a* is hardly influenced by the hot steam or gas released from the food since little or no space exists between the lid 5*a* and the food 5*d*. Therefore, the temperature rises slowly and the temperature change α is small.

The heating control according to the sequences of FIG. 4 is explained in detail. The first stage in FIG. 4 corresponds to steps S2–S9 in FIG. 3. For example, the output power of the magnetron 3 is set at 1500 [W] after the heating is started. When the detected temperature has risen by 18 [°C.], the operation proceeds to the second stage. When the initial temperature of the object 5 is high, the maximum temperature of 50 [°C.] may be reached before the detected temperature rises by 18 [°C.]. In this case, the time elapsed until then (exactly speaking, the elapsed time minus 5 [sec]) is adopted as the time length t0 before proceeding to the second stage.

The second stage corresponds to step S10 and the subsequent steps. The heating power is still maintained at 1500 [W]. When 5 [sec] has elapsed since entry into the second stage, one of the heating modes is selected according to the time length t0 and the temperature change α. When the detected temperature attains the maximum temperature, the operation proceeds to the third stage. If the maximum heating time elapses before the maximum temperature is attained, the operation also proceeds to the third stage at that time. In case that, referring back to step S10, the maximum temperature of 60 [°C.] is attained while the temperature change α is being measured (i.e. while the operation is suspended for 5 [sec]) in step S10, the temperature change α (which is defined for 5 [sec]) is calculated based on the time needed for the detected temperature to rise from the initial temperature to the maximum temperature 60 [°C.]. Then, one of the heating modes is selected according to the time length t0 and the temperature change α, and the operation proceeds to the third stage.

In the third stage, the heating is continued keeping the power at 1500 [W]. The heating is finished when the detected temperature attains the maximum temperature predetermined corresponding to the selected heating mode. The heating is otherwise finished when the maximum heating time (0.7×t) elapses before the detected temperature rises to the maximum temperature.

For example, referring to the curve B2 in FIG. 5, time length t0 in the first stage is 25 [sec] and the temperature change α after the start of the second stage is 9 [°C.]. Therefore, the heating mode B2 is selected when 5 [sec] elapses since the start of the second stage (i.e. at the point x in FIG. 5). According to the heating mode B2, the maximum heating time in the second stage is set at 0.75 [min] (45 [sec]) and the maximum temperature is set at 60 [°C.]. At the point y in FIG. 5, the detected temperature attains the maximum temperature of 60 [°C.] before the maximum heating time of 45 [sec] elapses since the start of the second stage. Thus, at the point y, the operation proceeds from the second stage to the third stage. The length of time t from the start of the first stage to the end of the second stage is 37 [sec]. Therefore, the maximum heating time in the third stage is set at 0.7×37=26 [sec] and the maximum temperature is set at 65 [°C.]. At the point z in FIG. 5, the detected temperature attains the maximum temperature of 65 [°C.] before the maximum heating time of 26 [sec] elapses. Hence, at the point z, the magnetron 3 is stopped and the heating is completed.

Normally, the maximum temperature is attained in each stage before the maximum heating time elapses as described above. In other words, the maximum heating time is provided for unusual cases as follows. When the object 5 is not placed in the proper position, the infrared sensor 8 detects the temperature of the turntable 6 instead of the temperature of the lid 5*a*. The maximum heating time prevents overheating of the food in such a case, and assures safety.

Also, the hygrosensor 10 may be utilized for safety. For example, such a situation should be considered that the object 5 is placed out of the detectable scope of the infrared sensor 8. In this case, an abnormal reference level for the detection signal of the hygrosensor 10 is predetermined in each stage, and when the detection signal exceeds the abnormal reference level, the operation proceeds to the next stage as when the detected temperature has attained the maximum temperature (or the operation is stopped).

In the microwave oven of the above embodiment, a plurality of input keys may be provided to the operation unit 23 and a plurality of heating sequences may be prepared corresponding to respective input keys. For example, the input keys may be provided corresponding to various types of packaged food such as "souzai", "donburi", "bentou", "onigiri" (rice ball) and "bread". The input keys may be otherwise provided corresponding to the preserving states of the food, or the temperature of food before a heating is started, such as "freezed", "chilled" and "preserved at normal temperature". By the microwave oven as described above, various types of packaged foods can be heated more appropriately.

In the above embodiment, the time required for the temperature to rise by a predetermined amount is used as the parameter representing the degree of rise in the temperature in the initial phase of the heating and the change in the temperature per unit time is used as the parameter representing the degree of rise in the temperature in the following phase of the heating. Of course the degree of rise in the temperature in the initial phase may be represented by the change in the temperature per unit time, and the degree of rise in the temperature in the following heating phase may be represented by the time required for the temperature to rise by a predetermined amount. In the initial phase, however, the inclination of the temperature curve changes much as the time elapses, as shown in FIG. 5. Therefore, the degree of rise in the temperature in the initial phase of the heating can be detected more precisely and easily by the method of the above embodiment.

What is claimed is:

1. A cooking method using a microwave oven having means for heating by microwave an object contained in a container with a lid and means for detecting a temperature at a top of the lid of the container, the cooking method comprising the steps of:

calculating a first parameter representing a degree of rise in the temperature detected by the temperature detecting means in an initial phase of a heating of the object;

calculating a second parameter representing a degree of rise in the temperature detected by the temperature detecting means after calculating the first parameter; and controlling the heating means based on the first and second parameters.

2. The method according to claim 1, wherein said first parameter is calculated during a predetermined period of time in the initial phase of the heating of the object; and the second parameter is calculated after the predetermined period of time.

3. The method according to claim 2, wherein the first parameter represents the degree of rise in the temperature during a period of time from when the heating of the object is started until a predetermined change in the temperature detected by the temperature detecting means is attained.

4. The method according to claim 3, wherein at least one of the step of calculating the first parameter or the step of calculating the second parameter further includes the step of calculating a time required for the temperature to rise by a predetermined amount.

5. The method according to claim 3, wherein at least one of the step of calculating the first parameter or the step of calculating the second parameter further includes the step of calculating a change in the temperature per unit time.

6. The method according to claim 3, wherein the step of calculating the first parameter includes calculating a period of time since the heating is started until a predetermined change in the temperature is attained, the step of calculating the second parameter includes calculating a change in the temperature per unit time since the predetermined change in the temperature is attained, and the step of controlling the heating means includes controlling the heating means based on the period of time and the change in the temperature per unit time.

7. The method according to claim 3, wherein the step of controlling the heating means includes controlling the heating means by changing a maximum heating time and/or a maximum temperature according to the first and second parameters.

8. The method according to claim 2, wherein the first parameter represents the degree of rise in the temperature during a period of time from when the heating of the object is started until a predetermined value of the temperature detected by the temperature detecting means is attained.

9. The method according to claim 8, wherein at least one of the step of calculating the first parameter or the step of calculating the second parameter further includes the step of calculating a time required for the temperature to rise by a predetermined amount.

10. The method according to claim 8, wherein at least one of the step of calculating the first parameter or the step of calculating the second parameter further includes the step of calculating a change in the temperature per unit time.

11. The method according to claim 8, wherein the step of controlling the heating means includes controlling the heating means by changing a maximum heating time and/or a maximum temperature according to the first and second parameters.

12. The method according to claim 2, wherein at least one of the step of calculating the first parameter or the step of calculating the second parameter further includes the step of calculating a time required for the temperature to rise by a predetermined amount.

13. The method according to claim 2, wherein at least one of the step of calculating the first parameter or the step of calculating the second parameter further includes the step of calculating a change in the temperature per unit time.

14. The method according to claim 2, wherein the step of controlling the heating means includes controlling the heating means by changing a maximum heating time and/or a maximum temperature according to the first and second parameters.

* * * * *